US010052782B2

(12) United States Patent
Sain

(10) Patent No.: US 10,052,782 B2
(45) Date of Patent: Aug. 21, 2018

(54) CAP CUTTING MACHINE

(71) Applicant: BORTOLIN KEMO S.P.A., Porcia (Pordenone) (IT)

(72) Inventor: Marino Sain, Roveredo in Piano (IT)

(73) Assignee: BORTOLIN KEMO S.P.A., Porcia (IT)

( * ) Notice: Subject to any disclaimer, the term of this patent is extended or adjusted under 35 U.S.C. 154(b) by 0 days.

(21) Appl. No.: 15/165,508

(22) Filed: May 26, 2016

(65) Prior Publication Data

US 2016/0354946 A1 Dec. 8, 2016

(30) Foreign Application Priority Data

Jun. 8, 2015 (IT) ..... 102015000021266

(51) Int. Cl.

| | |
|---|---|
| ***B26F 1/18*** | (2006.01) |
| ***B26D 7/01*** | (2006.01) |
| ***B26D 1/02*** | (2006.01) |
| ***B26D 3/08*** | (2006.01) |
| ***B26D 7/06*** | (2006.01) |

(52) U.S. Cl.

CPC ..... *B26F 1/18* (2013.01); *B26D 1/02* (2013.01); *B26D 3/08* (2013.01); *B26D 7/01* (2013.01); *B26D 7/06* (2013.01); *B26F 2210/04* (2013.01)

(58) Field of Classification Search

CPC ..... B26F 1/18; B26F 1/02; B26F 2210/04; B26D 3/08; B26D 7/01; B26D 7/06

USPC ..... 83/743, 745, 733

See application file for complete search history.

(56) References Cited

U.S. PATENT DOCUMENTS

| | | | | |
|---|---|---|---|---|
| 5,557,999 | A * | 9/1996 | Smith | B26D 3/08 413/10 |
| 5,651,299 | A | 7/1997 | Boyle et al. | |
| 5,660,289 | A * | 8/1997 | Spatz | B26D 7/01 215/252 |
| 2007/0089587 | A1* | 4/2007 | Liao | B26F 1/18 83/879 |
| 2012/0285302 | A1 | 11/2012 | Bergami | |
| 2014/0076116 | A1* | 3/2014 | Yamagishi | B26D 3/166 82/101 |
| 2016/0046032 | A1* | 2/2016 | Schillheim | B26D 3/11 30/151 |
| 2016/0354946 | A1* | 12/2016 | Sain | B26F 1/18 |

FOREIGN PATENT DOCUMENTS

| | | |
|---|---|---|
| CA | 1161611 A | 2/1984 |
| EP | 1243520 A1 | 9/2002 |

* cited by examiner

*Primary Examiner* — Omar Flores Sanchez

(74) *Attorney, Agent, or Firm* — Pearne & Gordon LLP

(57) ABSTRACT

A cap cutting machine, characterized by comprising:

a housing assembly (2), movable along a pre-determined path (P) and provided with a rotary housing (20) which is structured for housing a cap (C) and rotating the cap (C) about a first axis of rotation (X);

cutting means (3), conformed for cutting a side surface of the cap (C) and arranged along an active tract of the path (P);

motor means (5) structured for rotating the rotary housing (20) about the first axis of rotation (X) so that a side surface of the cap (C) comes into contact with the cutting means (3), thereby rolling without sliding with respect to the cutting means (3).

10 Claims, 9 Drawing Sheets

CAP CUTTING MACHINE

The invention has for an object a cap cutting machine for cutting caps. In particular the machine according to the present invention is arranged to perform cutting on the side surface of the cap so that a warranty ring is formed.

For the caps used for closing bottles destined to contain different types of substances, it is now essential to realize a warranty ring intended to become detached therefrom at the time of the very first opening of the bottle. In essence, the removal of the cap, which typically occurs by unscrewing, causes the warranty ring to become detached from the container, which indicates completion of the very first opening of the container.

At present, the cutting of the warranty ring occurs via machines that include one or more spindles whereon the caps are fitted. The caps are brought in contact with a series of concentric discs, at least one of which is a motor that sets the caps in rotation by friction on an outer surface.

A further disc is the blade that performs the cutting.

The machines currently available require that the caps are of rather regular shape, with a rather extended side surface and provided with a knurling which serves to promote rotary dragging of the caps by the motor disc.

Furthermore, cap cutting machines of the prior art are rather complex and less flexible.

In the event of a format change of the cap, there is in fact a need for the cutting machine to be tailor-made accordingly, and this is a long and laborious operation.

It is an object of the present invention to provide a machine which allows to overcome the drawbacks of the machines of the known type.

An advantage of the machine is to be able to operate even on irregularly shaped caps exhibiting complex and stepped side surfaces.

A further advantage of the machine is to allow rapid format changes.

Another advantage of the machine according to the invention is to be fast and reliable.

Further characteristics and advantages of the present invention will better emerge from the detailed description that follows of a preferred embodiment of the invention, illustrated by way of non-limiting example in the appended figures wherein.

In the preferred embodiment, the machine according to the present invention is of the rotary type. Essentially, the machine comprises a rotary turret disposed about a main axis of rotation (Y) to which the caps (C) to be processed are fed. The caps (C) are processed aboard the turret during rotation of the same up to an ejection station, from which the caps proceed to further manufacturing. The caps (C) are preferably fed via a is star device which is known to those skilled in the art and thus not shown in detail herein. Despite being the rotary structure described above particularly effective and compact, and thus the preferred one, it is not the only solution. The machine according to the invention could be in fact also implemented with a linear structure and perform its functions along a substantially rectilinear path.

Figure 1:
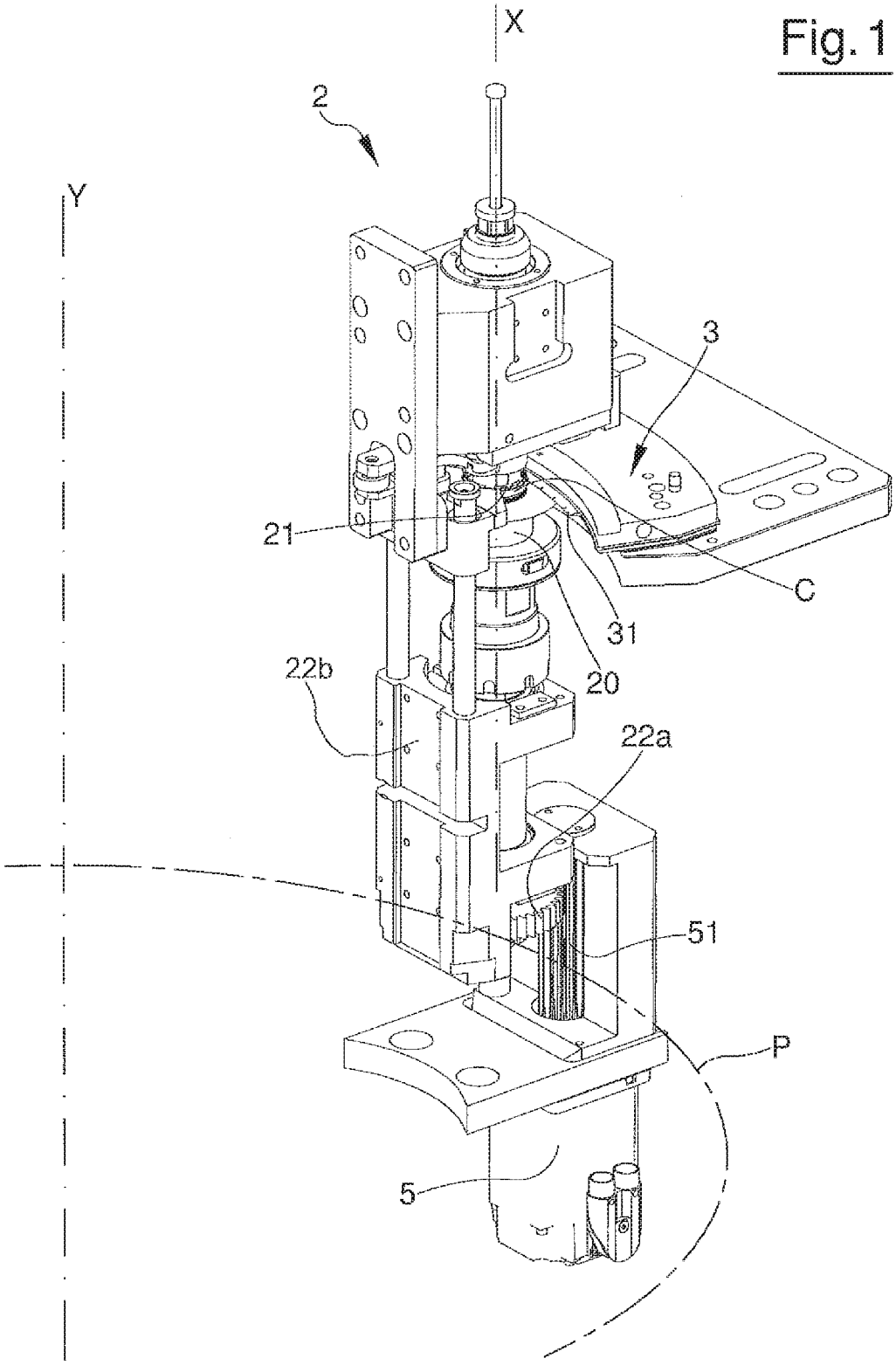
FIG. 1 shows a schematic axonometric view of the machine according to the present invention.
Figure 2:
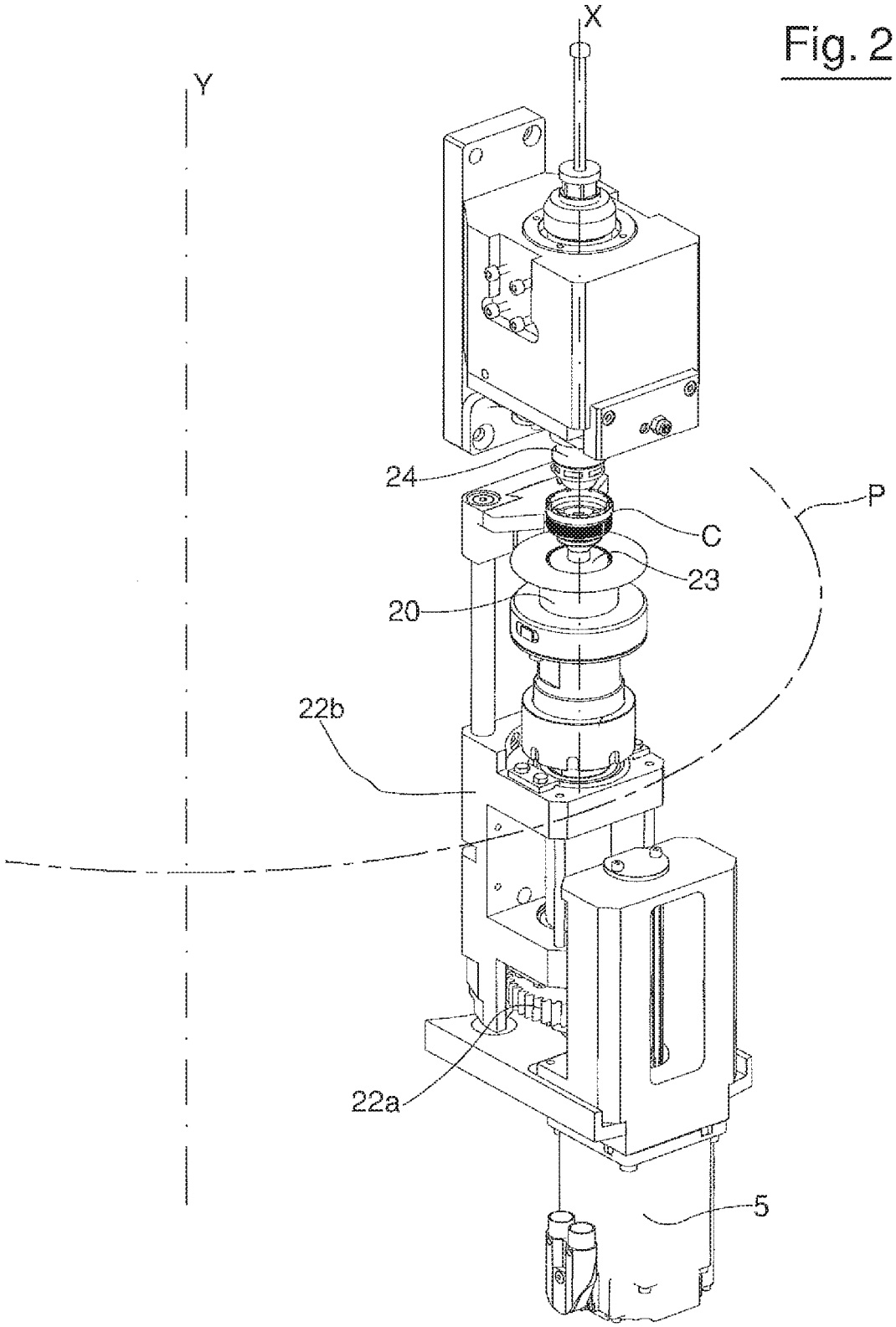
FIG. 2 shows an axonometric view of the machine of FIG. 1 from an opposite angle.

The machine comprises a housing assembly (2) which is movable along a pre-determined path (P). In the case of a rotary structure, the path (P) is a circular path, whereas in the case of a linear structure the path (P) might be rectilinear. The rotary turret or rotating structure may be provided with a plurality of housing assemblies (2) being distributed circularly at a constant angular pitch. For the sake of simplicity, FIGS. 1 and 2 illustrate a single housing assembly (2) with indication of the path (P) and the main axis of rotation (Y). The man skilled in the art is perfectly capable of arranging a turret-like rotating structure provided with a plurality of housing assemblies (2).

The housing assembly (2) is provided with a rotary housing (20) which is so structured as to accommodate a cap (C) and to make the cap (C) rotate about a first axis of rotation (X). The rotary housing (20) substantially exhibits an annular shape which delimits a cylindrical compartment (20*a*) that is concentric with the first axis of rotation (X) and open at the ends thereof. In the preferred embodiment of the machine the axis of rotation (X) is oriented vertically and a cap (C) can be inserted into the housing (20) through the upper end of the compartment (20*a*).

The cutting means (3) is so conformed as to perform a cutting on a side surface of the cap (C). The cutting means (3) is arranged along an active tract of the path (P), thereby exerting its action over a certain tract of the path (P) during the motion of the housing assembly (2) along the path (P) same.

Preferably the cutting means (3) comprises a circular cutting sector (31) concentric with the main axis of rotation (Y). The cutting sector (31) is stationary, i.e. arranged fixed along the active tract of the path (P). In an alternative embodiment not illustrated, the cutting means may assume a different conformation and/or be movable along the path (P).

The motor means (5) is so structured as to cause rotation of the rotary housing (20) about the first axis of rotation (X) so that, at least along the active tract of the path (P), the housing (20) moves according to a pure rolling motion with respect to the cutting means (3). This implies that a side surface of the cap (C) can come into contact with the cutting means (3) by rolling without sliding with respect to the latter. In other words, in the preferred embodiment, wherein the cutting means comprises a circular cutting sector (31), the action of the motor means (5) causes the rotary housing (20) to move according to a pure rolling motion with respect the circular cutting sector (31), which implies that also a cap (C) contained in said rotary housing (20) exhibits a pure rolling motion relative to the circular cutting sector (31).

The idea of producing a pure rolling motion of the cap (C) with respect to the cutting means (3), by means of the rotary housing (20), determines considerable advantages. First of all, the rotary housing (20) is capable of setting in rotation complex-shaped caps (C) exhibiting side stepped surfaces (as the cap shown in the figure) and/or knurls-free side surfaces. In addition, the cutting which is obtained as a result of a pure rolling motion is particularly accurate and clean and further allows to simplify the structure of the cutting means (3), which cutting means (3) may even take on the above-described circular cutting sector (31) configuration.

The motor means (5) comprises for example a servo motor that is configured for rotating the rotary housing (20) about the first axis of rotation (X). The servo motor is governed by a control unit, not shown, which is capable of implementing rotation of the motor in order to obtain the effects described above. The solution of adopting independent motor means (5) for each rotary housing (20) simplifies the structure of the machine from the mechanical viewpoint in that, owing to this configuration, complex mechanical transmissions are not required, moreover the presence of independent motor means (5) makes it possible to control rotation of each rotary housing (20) in the desired manner.

The rotary housing (20) is further slidingly movable along the first axis of rotation (X) between a lower position, relative to which a cap (C) can be aligned to the rotary housing (20), and an upper position, at which the rotary housing (20) is arranged around is the cap (C). In the upper position, the rotary housing (20) leaves uncovered the zone of the cap (C) intended to come into contact with the cutting means (3). The possibility of translating the rotary housing (20) between the lower position and the upper position, allows to feed the caps (C) by way of a rotary star feeder, not shown, which is known to be easy-to use, reliable and fast.

The housing assembly (2) comprises a lower portion (22) with which the rotary housing is associated (20). The lower portion (22) is movable in rotation about the first axis of rotation (X). The lower portion (22) is further associated with a support (22*b*) which is slidingly movable along the first axis of rotation (X) for translating the housing (20) between the lower and upper positions.

In particular, the motor means (5) transmits the rotary motion to the lower portion (22) via a toothed shaft (51) that meshes with a toothed wheel (22*a*) that is rotatingly integral with the lower portion (22). The sliding motion along the first axis of rotation (X) is instead transmitted to the support (22*b*) via a fixed cam profile (CP), which interacts with the support (22*b*) itself during the motion along the path (P).

Figure 3:
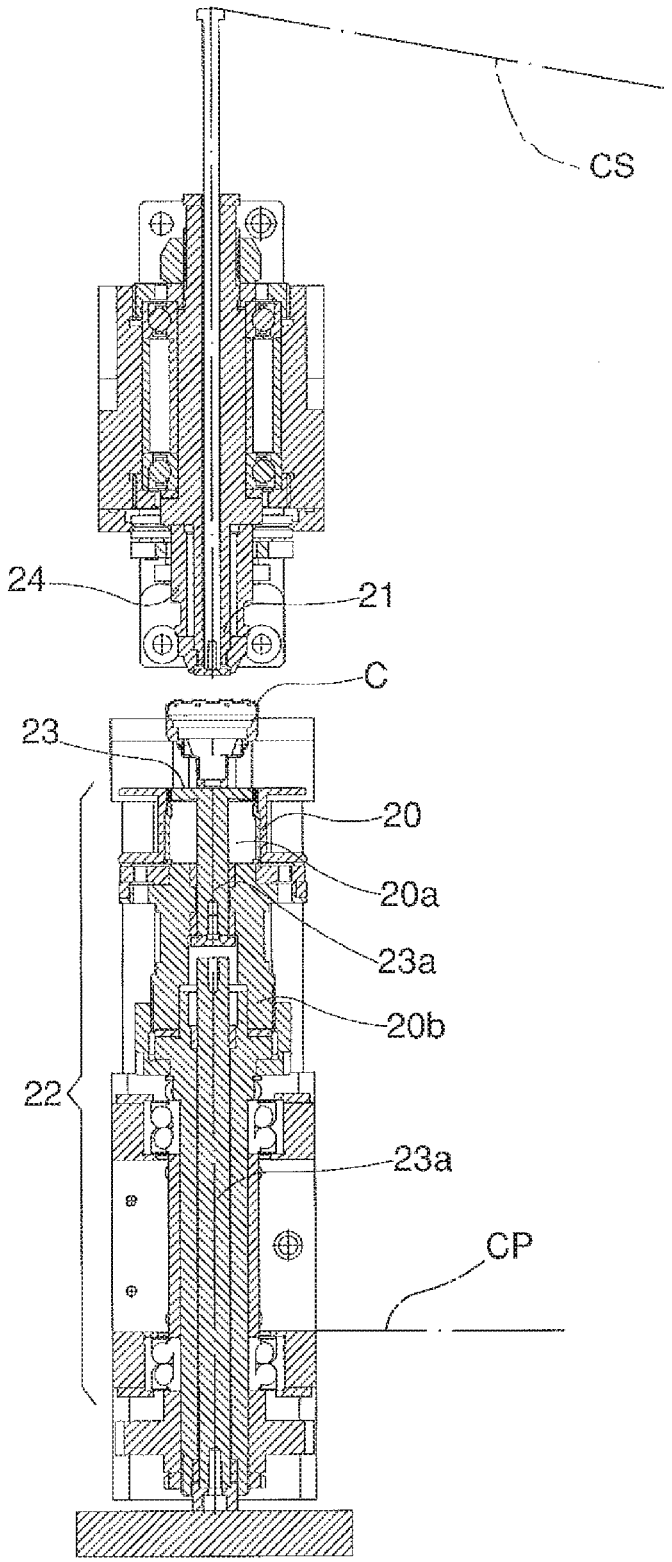
FIGS. 3 to 7 show the machine in cross-section according to the present invention taken on a plane containing a longitudinal axis (X) in different operating configurations.
Figure 5:
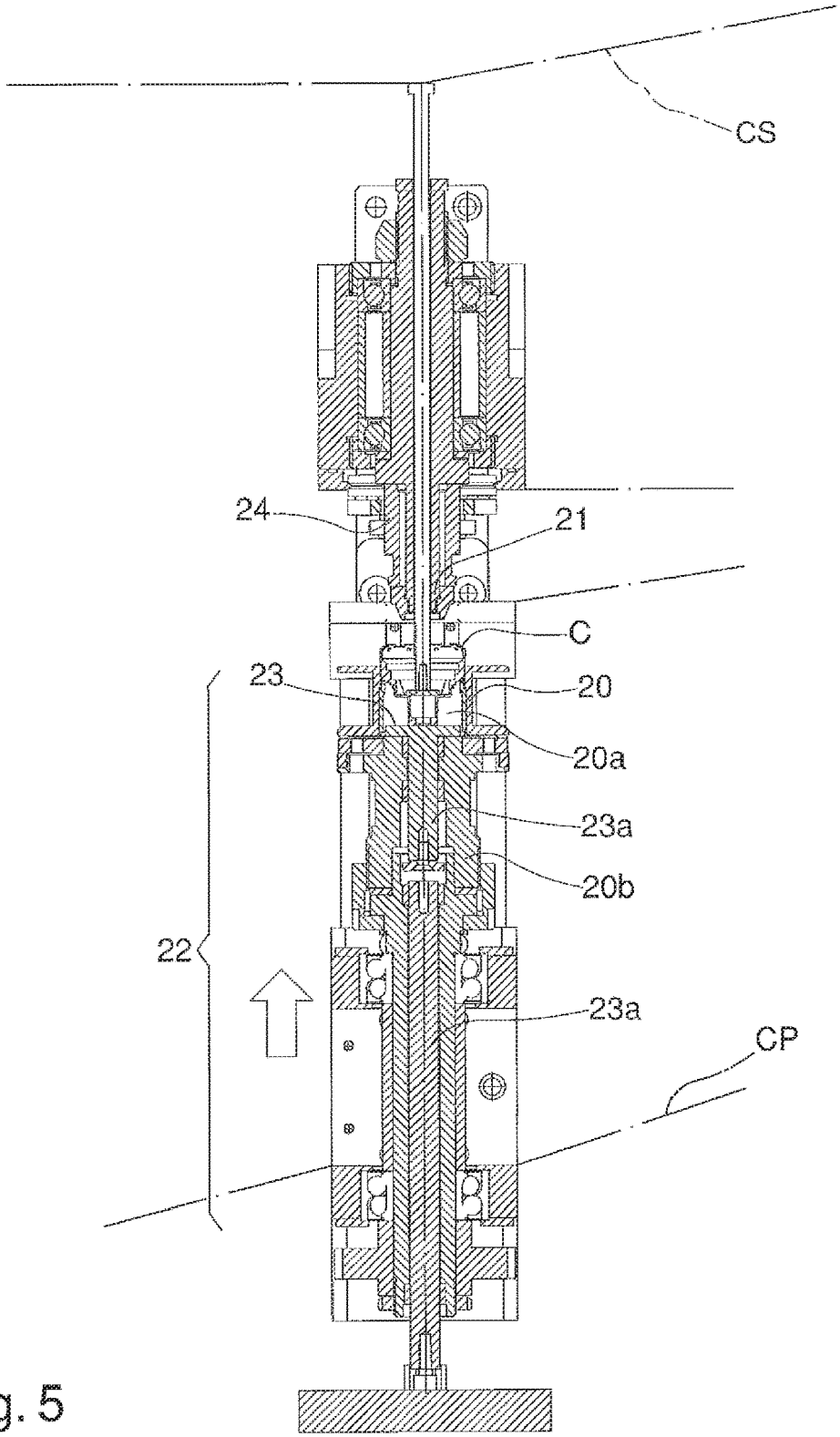
Figure 6:
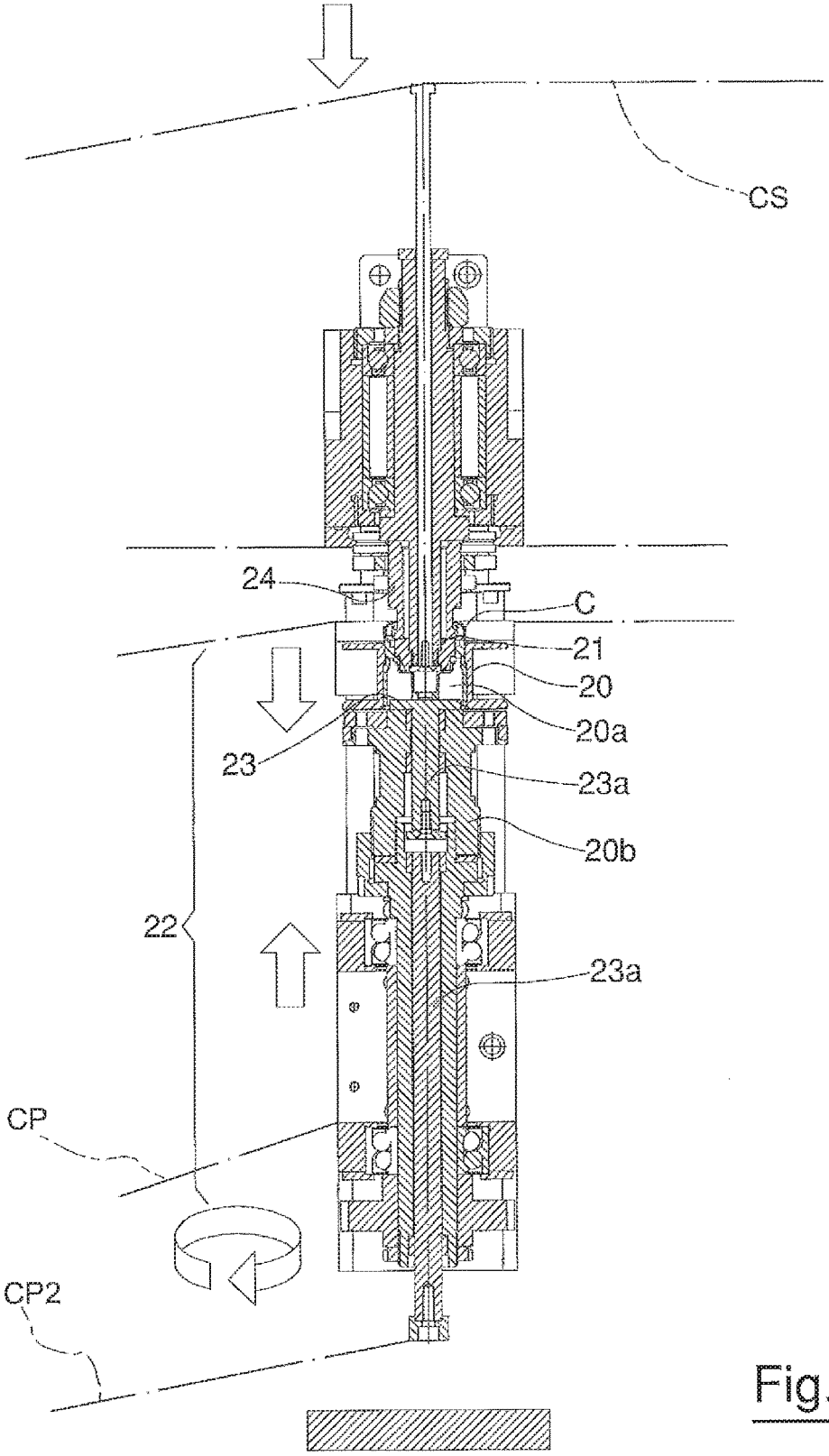
Figure 7:
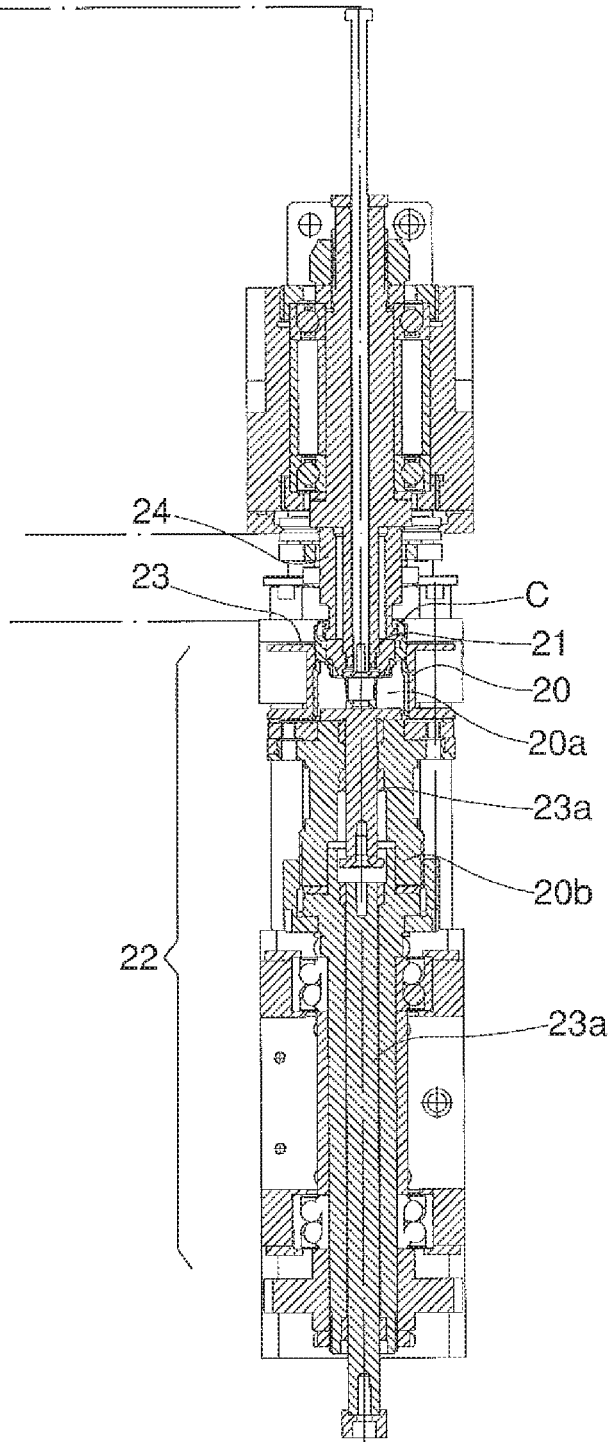

In the lower position of the rotary housing (20) shown in FIG. 3, a cap (C) can be positioned above the rotary housing (2), which cap (C) is substantially aligned and concentric with respect to the first axis of rotation (X). In the upper position of the rotary housing (20), illustrated in FIG. 5, the cap (C) is placed at least partially within the rotary housing itself (20). A portion of the cap (C), whereon the cutting is to be effected, remains protruding from the rotary housing (20).

Figure 4:
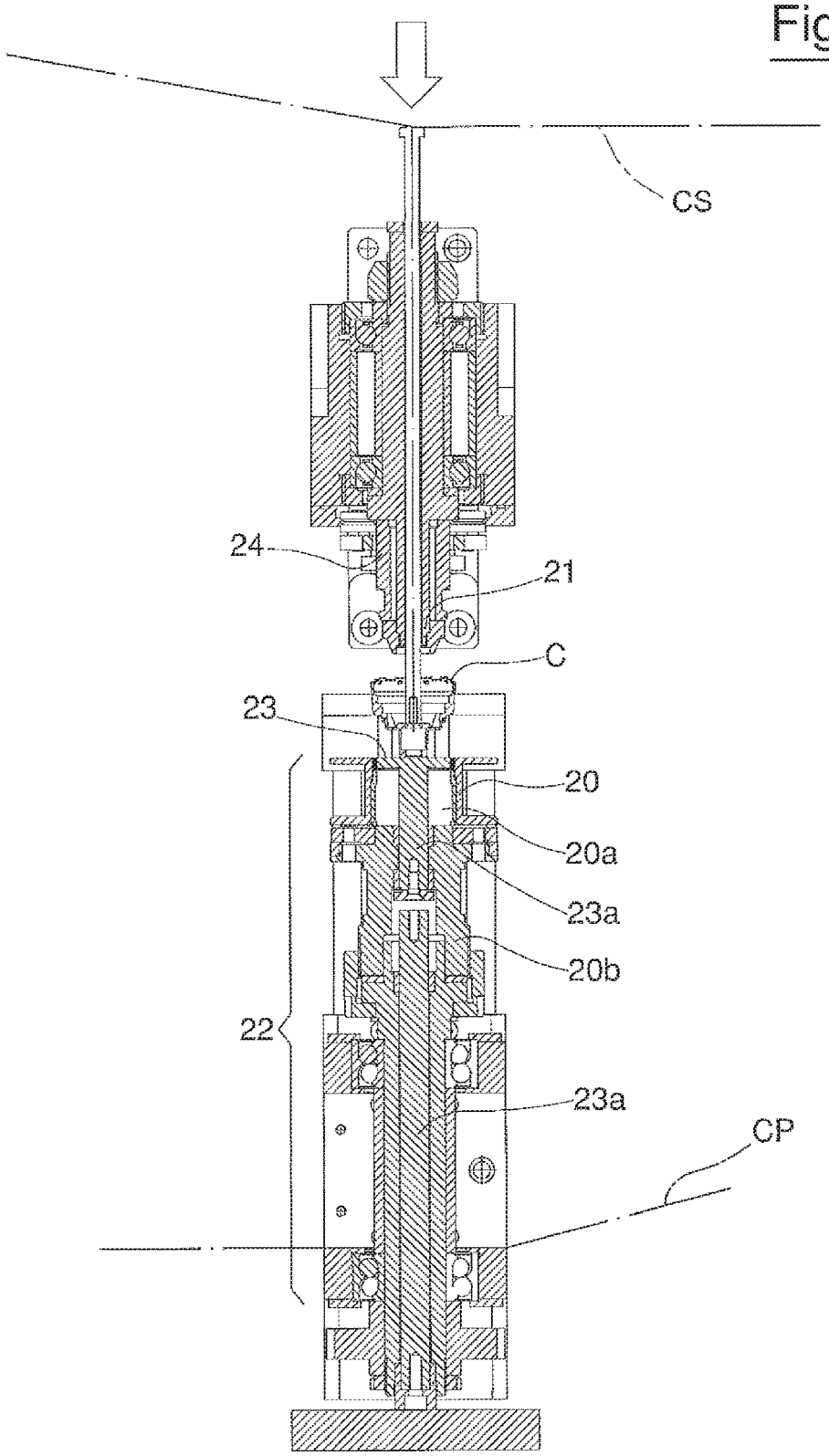

The housing assembly (2) comprises an abutment (23), which is disposed internally of the rotary housing (20). The abutment (23) substantially performs the function of bottom of the rotary housing (20) and of resting base for a cap (C). To this end the rotary housing (20) and the abutment (23) are movable one to another along the first axis of rotation (X), between a first position, visible in FIGS. 3 and 4, in which the abutment (23) is located at an upper edge of the housing (20), and a second position, visible in FIG. 5, in which the abutment (23) is located at a lower edge of the housing (20). In the preferred embodiment of the machine, the rotary housing (20), by means of the support (22*b*), is slidable along the first axis of rotation (X) with respect to the abutment is (23). The first and second position are then defined by the position assumed by the rotary housing (20). In the embodiment shown, the abutment (23) is integral with a pin (23*a*), in a single piece or in two portions, which is coaxial with the first axis of rotation (X) and which is passing through the lower portion (22) of the housing assembly (2), wherefrom it protrudes downwards.

Preferably the rotary housing (20) is removable from the housing assembly (2), and in particular is removable with respect to the lower portion (22). In this way the rotating housing (20) may be replaced according to the characteristics of the cap to be treated. The housing assembly (2) further comprises a locking pin (21) arranged superiorly to the rotary housing (20) and substantially concentric with the first axis of rotation (X). The locking pin (21) is so structured as to be disposed at least partially internally of the rotary housing (20).

The locking pin (21) is movable between a first upper position in the embodiment shown, in which the locking pin (21) is located at a greater distance from the rotary housing (20), and a second lower position, wherein such locking pin (21) is located at a smaller distance from the rotary housing (20) and can be arranged at least partially internally of the latter, pressing the cap (C) on the bottom of the rotary housing (20) itself, The displacement of the locking pin (21) is implemented by way of a fixed cam profile (CS), illustrated only schematically, which interacts with one end (21*a*) of the pin (21) itself.

The displacement of the locking pin (21) is synchronized with the displacement of the rotary housing (20) in the following way. Starting from the initial configuration of FIG. 3, the locking pin (21), which is in its first position, moves toward the its second position (FIG. 4), in which it is arranged inside the cap (C) and presses the latter against the abutment (23). Thereafter, the housing (20) moves from its lower position to the upper position (FIG. 5), surrounding the cap (C).

The housing assembly (2) is further provided with a contrast bush (24), which is structured for pushing the cap (C) towards the cutting means (3).

In particular, the bush (24) is arranged concentrically to the first axis of rotation (X). In the embodiment represented, the bush (24) is concentric with the locking pin (21).

The bush (24) is movable along a direction perpendicular to the axis of rotation (X) between an active position, at which it is located at a smaller distance from the cutting means (3) along the active tract of the path (P), and an inactive position, at which it is located at a greater distance from the cutting means (3) along the active tract of the path (P). In practice, in passing from the inactive position to the active position, the bush (24) moves away radially from the main axis of rotation (Y). In the active position, the bush (24) comes in contact with a side area of the cap (C) and is able to press a cap (C) in contact with the cutting means (3) during rotation of the cap itself by virtue of the rotary housing (20). In the inactive position the bush (24) can be inserted into or extracted from the cap (C). The rotary bush (24) is free to rotate about the first axis of rotation (X), in order to not hinder rotation of the cap (C).

Figure 8:
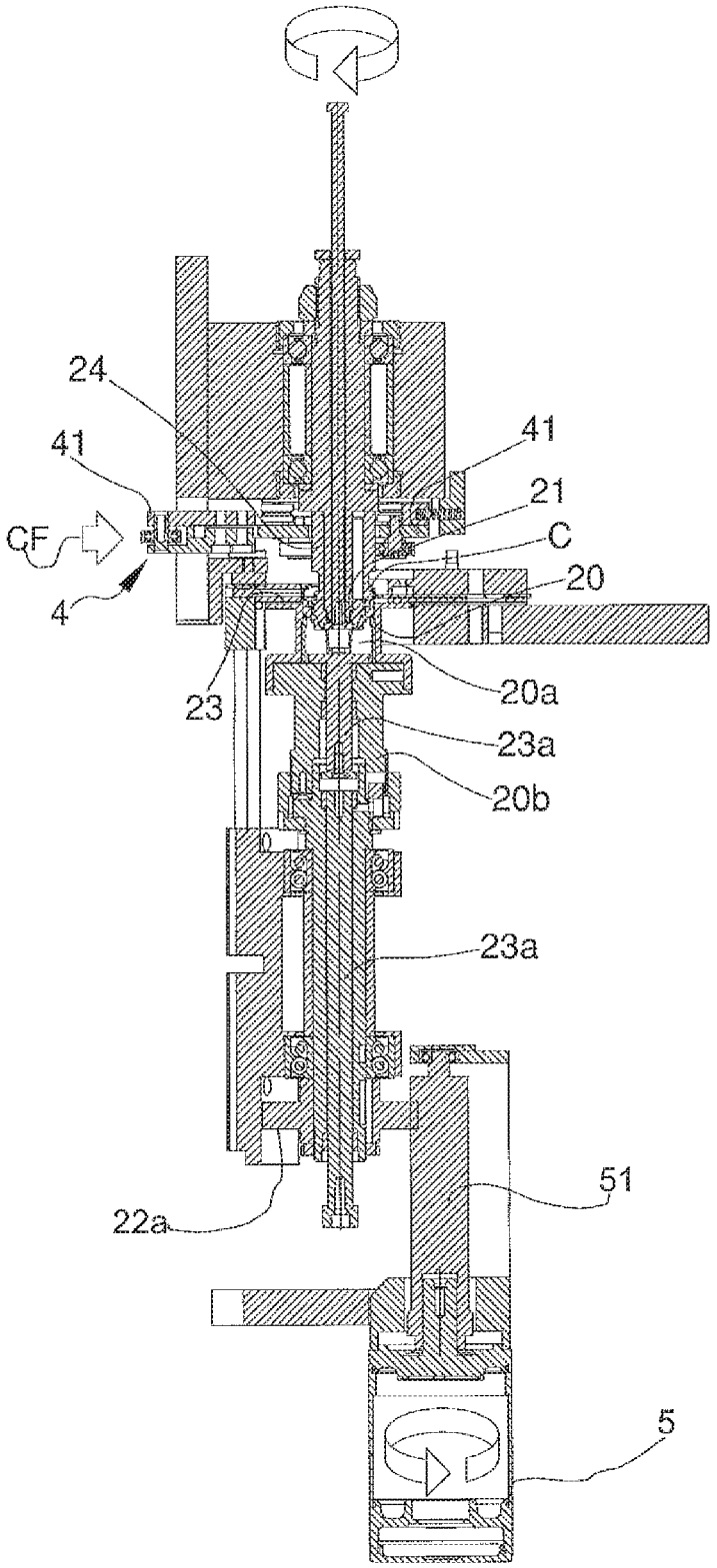
FIG. 8 shows a view in section on a longitudinal plane of the machine of FIG. 7 seen from the left.
Figure 9:
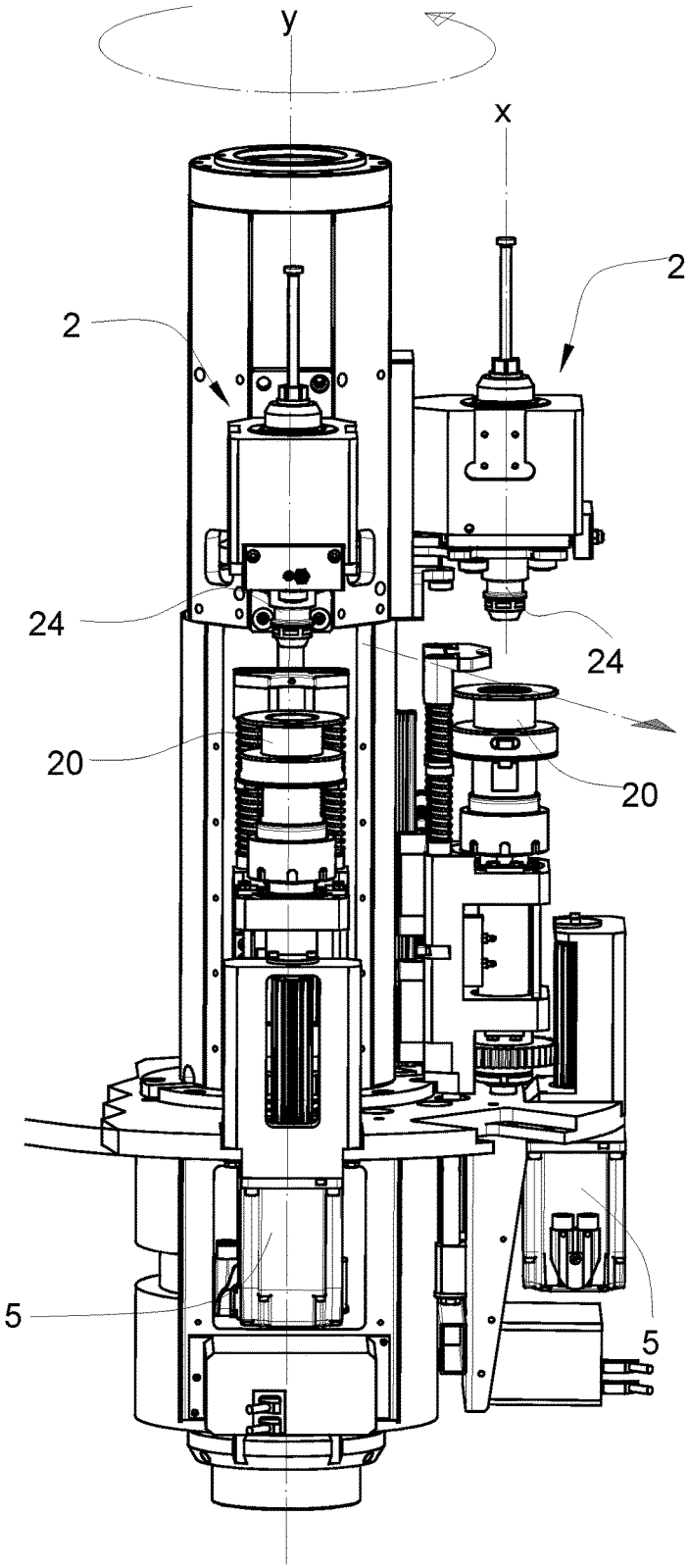
FIG. 9 shows a cap cutting machine with two or more housing assemblies with independent motor means for each rotary housing.

Shifting means (4) are capable of moving the contrast bush (24) from the inactive position to the active position along the active tract of the path (P). Such shifting means (4) comprises an annular element (41) arranged around the bush (24). The annular element (41) is in turn movable in the direction perpendicular to the first axis of rotation (X) for translating the bush (24) between the active and inactive positions. The shifting of the annular element (41) is obtained by means of a fixed cam (CF), depicted schematically in FIG. 8, which comes into contact with the annular element at least along the active tract of the path (P), i.e. along the tract in which the cutting means (3) comes into contact with the cap (C).

The action of the contrast bush (24) takes place in the following manner. Starting from the configuration of FIG. 5, wherein the locking pin (21) is in the lower position and the rotary housing (20) is in the upper position, the lower portion (22), as well as the rotary housing (20) and the abutment (23), move towards the bush (24), thereby assuming a cutting position in which the bush (24) is inserted into the cap (C) and presses the latter into the rotary housing. The displacement of the rotary housing (20) in the cutting position is obtained via the support (22*b*) and the cam profile (CP). The displacement of the abutment (23) in the cutting position is obtained via a second fixed cam profile (CP2) that is substantially parallel to the first cam profile (CP) but is out of phase by a pitch which is sufficient to enable initially the displacement of the rotary housing (20) in is the upper position thereof, and thereafter the simultaneous displacement of the rotary housing (20) and of the abutment (23) towards the cutting position. The second cam profile (CP2) interacts with the end of the pin (23*a*) to which the abutment (23) is associated.

The locking pin (21) yields to the pressure exerted by the abutment (23), whereby the locking pin (21) returns upwards thanks to the presence of an elastic element, for example a pneumatic spring. Subsequently the bush (24) moves towards its active position (FIG. 8), wherein it is arranged in contact with a side part of the cap (C) and pushes the cap (C) towards the cutting means (3) and in contact with the same, along the active tract of the path (P). Simultaneously the rotary housing (20) has been set in rotation by the motor means (5) in order to perform cutting through the pure rolling motion of the cap (C) on the cutting means (3).

Once performed the cutting of the cap (C), each housing assembly (2) performs the movements described above in reverse order, thus returning into the initial configuration of FIG. 3 to receive a new cap (C), all this during the displacement along the path (P), i.e. during rotation of the rotating turret to which the housing assemblies (2) are associated.

A phasing of the angular position of the cap (C) with respect to the first axis of rotation (X) may be further performed. Such phasing may be obtained for example via optical means capable of detecting the angular position of the cap. The detected angular position is transmitted to the control unit which drives the motor means (5) for rotating the rotary housing (20) to obtain the desired angular position.

The machine according to the present invention achieves important advantages. First of all, it allows to perform circular cutting on complex-shaped and/or lateral knurling-free caps. Furthermore, the cutting performed through the pure rolling motion of the cap on the cutting means, is very accurate which result in cutting means easy to use and obtainable at low cost.

The various movements necessary to perform cutting on the caps are obtained through simple and effective mechanisms. Moreover, use of motor means (5) that is independent for each housing assembly (2), allows to increase flexibility of the machine is that can be tailored to the caps exhibiting different shape and different diameter.

The invention claimed is:

1. A cap cutting machine, comprising: two or more housing assemblies (2), each movable along a pre-determined path (P) and provided with a rotary housing (20) which is structured for housing a cap (C) and rotating the cap (C) about a first axis of rotation (X);

cutting means (3), conformed for cutting a side surface of the cap (C) and arranged along an active tract of the path (P);

motor means (5), structured for rotating each rotary housing (20) about the first axis of rotation (X) so that a side surface of the cap (C) comes into contact with the cutting means (3), thereby rolling without sliding with respect to said cutting means (3);

wherein the cap cutting machine comprises independent motor means (5) for each rotary housing (20).

2. A cap cutting machine according to claim 1, wherein the motor means (5) comprises a motor configured for rotating the rotary housing (2) about the first axis of rotation (X).

3. A cap cutting machine according to claim 1, wherein the path (P) is a circular path concentric to a main axis of rotation (Y), which main axis of rotation (Y) is parallel to the first axis of rotation (X).

4. A cap cutting machine according to claim 3, comprising a rotary structure or movable turret rotating about the main axis of rotation (Y), to which rotary structure are associated a plurality of housing assemblies (2) distributed circularly.

5. A cap cutting machine according to claim 3, wherein the cutting means (3) comprises a circular cutting sector (31), which is concentric with the main axis of rotation (Y).

6. A cap cutting machine according to claim 1, wherein the rotary housing (20) is slidingly movable along the first axis of rotation (X) between a lower position, relative to which a cap (C) can be aligned with the rotary housing (20), and an upper position, relative to which the rotary housing (20) is arranged around the cap (C).

7. A cap cutting machine according to claim 1, wherein the housing assembly (2) comprises a locking pin (21), substantially concentric with the first axis of rotation (X) and structured for being disposed at least partially within the rotary housing (20) and for pressing a cap (C) onto the bottom of the rotary housing (20).

8. A cap cutting machine according to claim 1, comprising a contrast bush (24) movable along a direction perpendicular to the axis of rotation (X), between an active position, in which said contrast bush (24) is located at a smaller distance from the cutting means (3) along the active tract of the path (P) and can tighten a side portion of a cap (C) in contact with the rotary housing (20), and an inactive position, in which the contrast bush (24) is located at a greater distance from the cutting means (3), along the active tract of the path (P).

9. A cap cutting machine according to claim 8, comprising shifting means (4), predisposed for shifting the contrast bush (24) from the inactive position to the active position along the active tract of the path (P).

10. A cap cutting machine according to claim 1, wherein the housing assembly (2) comprises a lower portion (22), which is solidly constraint with the rotary housing (20), which lower portion (22) is rotatably movable about the first axis of rotation (X) and slidingly movable along the first axis of rotation (X) between a lower position, relative to which a cap (C) can be aligned to the rotary housing (20), and an upper position, in which the rotary housing (20) is arranged around the cap (C), thereby leaving exposed the area of the cap (C) which is intended to come into contact with the cutting means (3).

* * * * *